US005145092A

United States Patent [19]

Shannon

[11] Patent Number: 5,145,092

[45] Date of Patent: Sep. 8, 1992

[54] SYRUP DISPENSING SYSTEM FOR SOFT DRINK DISPENSER

[75] Inventor: Joseph W. Shannon, Kent, Ohio

[73] Assignee: ABC/TechCorp, Akron, Ohio

[21] Appl. No.: 664,775

[22] Filed: Mar. 5, 1991

[51] Int. Cl.[5] ..... B67D 5/08

[52] U.S. Cl. ..... 222/61; 222/64; 222/66; 222/638; 222/136; 222/152; 222/394

[58] Field of Search ..... 222/23, 64–68, 222/129.1–129.4, 135, 136, 152, 638–641, 426, 428, 450, 61, 394, 399

[56] References Cited

U.S. PATENT DOCUMENTS

| | | | |
|---|---|---|---|
| 4,406,382 | 9/1983 | Roth | 222/64 |
| 4,615,466 | 10/1986 | Credle, Jr. | 222/129.1 |
| 4,624,391 | 11/1986 | Shannon | 222/152 X |
| 4,687,120 | 8/1987 | McMillin | 222/129.1 X |
| 4,898,303 | 2/1990 | Large et al. | 222/65 |
| 4,903,862 | 2/1990 | Shannon et al. | 222/641 X |

FOREIGN PATENT DOCUMENTS

| | | | |
|---|---|---|---|
| 0322729 | 7/1989 | European Pat. Off. | 222/64 |
| 1128073 | 1/1957 | France | 222/64 |

*Primary Examiner*—Kevin P. Shaver
*Attorney, Agent, or Firm*—Renner, Kenner, Greive, Bobak, Taylor & Weber

[57] ABSTRACT

A syrup dispensing assembly is provided for a soft drink dispenser. This assembly includes a plurality of syrup supply sources in communication with a plurality of syrup pumps. Each of the pumps is interconnected with a common manifold connected at one end to a source of $CO_2$ gas under pressure, and at the other end by a vacuum pump. Actuation of a valve allows the gas pressure source to pressurize the pumps for dispensing. Closure of that valve and actuation of the vacuum pump allow the pumps to refill with syrup from the syrup supply sources. The system can operate with any of various types of syrup supplies, as well as combinations of such supplies.

16 Claims, 1 Drawing Sheet

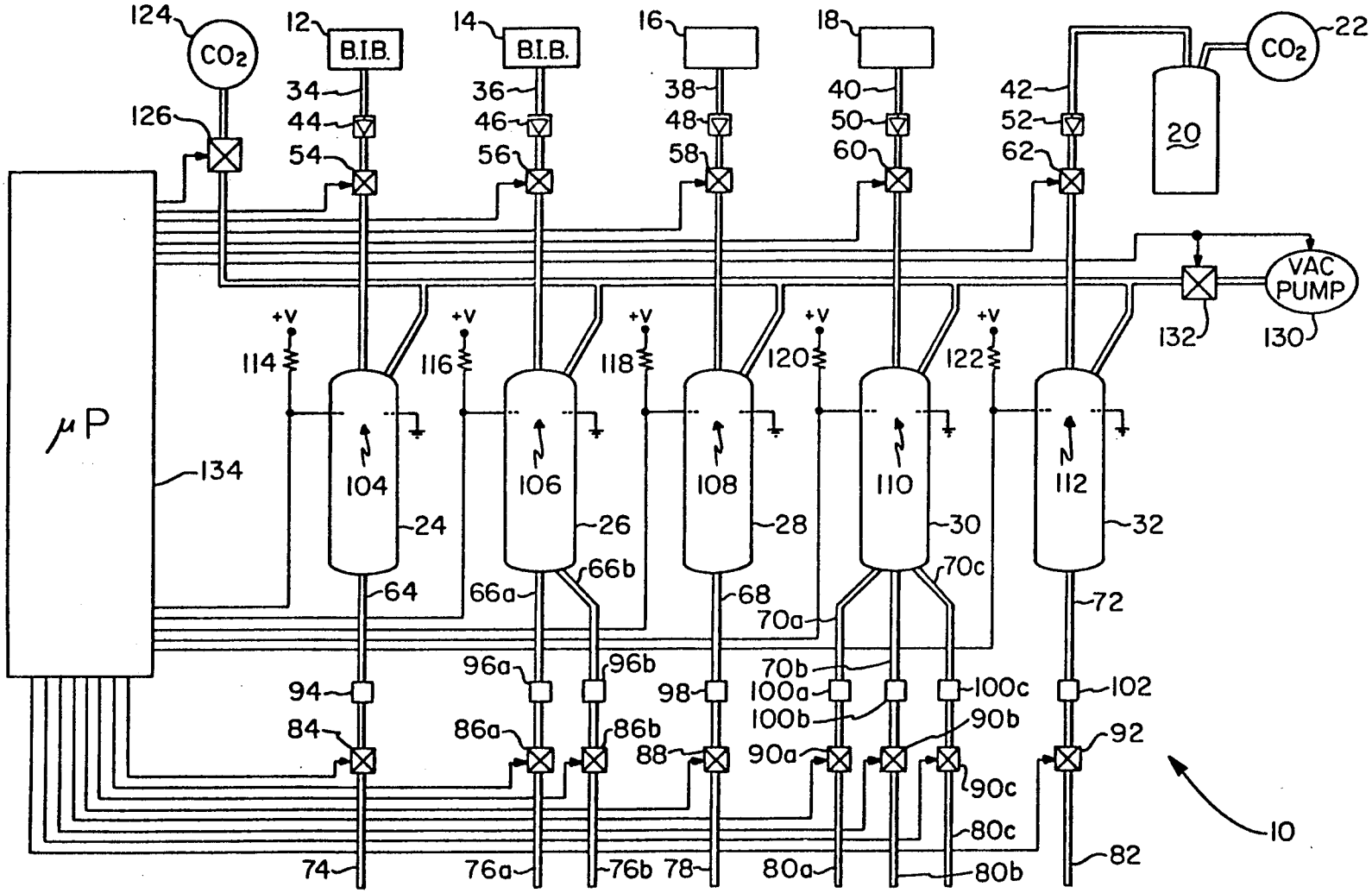
CO2
VAC PUMP
B.I.B.
B.I.B.
CO2
μP
+V

SYRUP DISPENSING SYSTEM FOR SOFT DRINK DISPENSER

TECHNICAL FIELD

The invention herein resides in the art of soft drink dispensers and, more particularly, to a syrup dispensing system therefore. Specifically, the invention presents a syrup dispensing system which is operative for implementation with any of various types of syrup sources.

BACKGROUND ART

It is well known that soft drinks typically comprise a combination of soda or carbonated water and an appropriate flavoring syrup. Accordingly, soft drink dispensers typically include both a soda dispensing system and a syrup dispensing system, the soda and syrup being combined at the dispensing head or within the drink receptacle. The invention herein relates particularly to a syrup dispensing system for such soft drink dispensers.

Presently known syrup dispensing systems are of various types. The traditional canister system employs a pressurized canister of syrup, driven by a head of carbon dioxide ($CO_2$) gas. Such systems are bulky, expensive to establish and maintain, and given to changes in drink consistency resulting from pressure head changes as the canister depletes. Further, "slugs" of gas often appear in the dispensing lines in such $CO_2$ driven systems. It is further known that various syrups carbonate at different pressures so care must be taken as to the pressure head of $CO_2$ gas used to drive the various syrups.

Other known syrup systems have incorporated the commonly known "bag-in-box" concept. In such prior systems, a separate vacuum pump is required for each bag-in-box supply, such pumps being costly, unreliable, inaccurate, and given to limitations as to the associated rates at which syrup can be dispensed. Specifically, such bag-in-box systems are given to significant limitations as to the number of stations that can be serviced by a single bag-in-box source and pump. Finally, the pumps in the known bag-in-box systems are typically driven by $CO_2$ gas, and the operation thereof necessarily wastes this somewhat costly commodity.

While the prior art has not taught systems mixing canister and bag-in-box sources of syrup, it is presently understood that such a mix would typically require that a pressure regulator be associated with each of the syrups in such a system to assure accurate and consistent dispensing.

The prior has also typically failed to employ gravity feed systems. This failure is due, in part, to the fact that it has typically been believed that some type of pressure source or pump must necessarily be associated with each syrup source to assure proper dispensing.

There is a need in the art for a syrup dispensing system which can eliminate the costly and unreliable pressurized canisters of the prior art, as well as the expensive and unreliable bag-in-box systems, requiring a separate pump for each bag-in-box supply. There is clearly a need in the art for a syrup dispensing system which reduces costs, increases accuracy and reliability, assures complete depletion and utilization of syrup from the supply, accommodates faster dispensing rates for high capacity installations, and allows the intermixing of various types of syrup sources in the syrup dispensing portion of a soft drink dispenser.

DISCLOSURE OF INVENTION

In light of the foregoing, it is a first aspect of the invention to provide a syrup dispensing system for a soft drink dispenser which allows for complete depletion of syrup from the syrup sources.

Another aspect of the invention is the provision of a syrup dispensing system for a soft drink dispenser in which higher dispensing rates can be achieved than with previously known systems.

Still a further aspect of the invention is the provision of a syrup dispensing system for a soft drink dispenser in which a bag-in-box system may be employed without the necessity of a pump being associated with each bag-in-box station.

Yet another aspect of the invention is the provision of a syrup dispensing system for a soft drink dispenser which is less costly, while being more reliable and accurate than previously known systems.

Still a further aspect of the invention is the provision of a syrup dispensing system for a soft drink dispenser which eliminates the likelihood of gas entering the dispensing line.

An additional aspect of the invention is the provision of a syrup dispensing system for a soft drink dispenser in which various sources of syrup can be employed and/or mixed, including bag-in-box sources, pressurized canister sources, and gravity feed bulk sources.

The foregoing and other aspects of the invention which will become apparent as the detailed description proceeds are achieved by a syrup dispensing assembly for a soft drink dispenser, comprising: a supply of syrup; a dispensing head; pump means interposed between said supply of syrup and dispensing head for receiving syrup from said supply and passing it to said dispensing head; and vacuum generating means interconnected with said pump means for drawing syrup from said supply to said pump means.

Still other aspects of the invention which will become apparent herein are attained by a syrup dispensing assembly for a soft drink dispenser, comprising: a plurality of pumps, each pump defining a chamber; a plurality of sources of syrup in selective communication with said chambers of said pumps; a pressure source in selective communication with said chambers of said pumps; a vacuum source in selective communication with said chambers of said pumps; and control means interconnected with said pressure source and said vacuum source for selectively and mutually exclusively enabling and inhibiting communication of said pressure and vacuum sources with said chambers of said pumps.

DESCRIPTION OF DRAWING

For a complete understanding of the objects, techniques and structure of the invention reference should be made to the following detailed description and accompanying drawing wherein there is shown a schematic block diagram of the syrup dispensing system of the invention.

BEST MODE FOR CARRYING OUT THE INVENTION

Referring now to the drawing, it can be seen that the syrup dispensing assembly for a soft drink dispenser is designated generally by the numeral 10. The assembly 10 is shown to operate with various sources of syrup supply. By way of example, several syrups are provided in the bag-in-box fashion as at 12, 14. Bulk reservoirs of other syrups are provided by means of the tanks 16, 18. Finally, a pressurized syrup tank 20 provides still another syrup under a pressure head provided by a regulated source of $CO_2$ gas 22. It will be appreciated by those skilled in the art that the source 22 is regulated to provide for a substantially constant pressure head within the tank 20.

Uniquely associated with each of the syrup supply sources 12–20, is one of the dispensing pumps 24–32. These pumps are generally well known in the art, as shown, by way of example, in U.S. Pat. No. 4,903,862. The pumps 24–32 are pressure driven, obviating any need for pistons, diaphragms, and the like. The pumps 24–32 communicate with associated syrup supply sources 12–20 through respective conduits or fill lines 34–42. Positioned within each of the fill lines 34–42 and interposed between the respective pumps 24–32 and syrup supply sources 12–20 are respective check valves 44–52, serving as safety means to preclude any back pressure from the pumps reaching the syrup supplies.

Also interposed in the fill lines 34–42 are respective fill valves 54–62, the same preferably being electrically actuated solenoid valves as are well known to those skilled in the art.

At the bottoms of each of the pumps 24–32 are respective dispensing lines. As shown, the pump 24 has a single dispensing line 64, indicating that it services a single dispensing head or station. The pump 26 has dual dispensing lines **66*a* and 66*b* suggesting that this pump may service two separate dispensing heads or stations. The pumps 28, 32, similar to the pump 24, have respective single dispensing lines 68, 72, again indicating that only a single dispensing station or head is serviced. Finally, pump 30 has three dispensing lines 70*a*, 70*b*, and 70*c* indicating that three separate dispensing heads or stations can be serviced by that pump. It will be appreciated that, in a typical syrup dispensing system, each of the pumps would service the same number of dispensing heads or stations. The arrangement shown in the drawing is for illustrative purposes only. It will further be appreciated that the dispensing heads 74, 76*a*, 76*b*, 78, 80*a*, 80*b*, 80*c*, 82 are dispensing heads of the type well known in the art, and for purposes of this invention may be of any suitable nature. Received within the respective dispensing lines and interposed between the associated pump and dispensing head are respective dispensing valves 84, 86*a*, 86*b*, 88, 90*a*, 90*b*, 90*c*, 92**. These valves, again as well known and understood by those skilled in the art, would typically comprise an electrically actuated solenoid dispensing valve.

Of particular interest to the concept of the invention is the inclusion in each of the dispensing lines, between the respective pumps and dispensing heads, of a metering adjustment valve **94, 96*a*, 96*b*, 98, 100*a*, 100*b*, 100*c*, 102. These metering valves are provided with screw adjustments, as particularly illustrated with the metering valve 94, to regulate or adjust the rate of flow of syrup through the associated line 64 and dispensing head 74. As will be understood later herein, each of the pumps 24–32 will typically be subjected to the same pressure head for dispensing of syrup. Since the syrups in each of the various pumps 24–32 may be of a different nature, having different viscosities, the rates of flow of the syrups from the associated dispensing heads may be set by means of dilation or constriction of the associated metering valves 94–102**.

Received within each of the pumps 24–32 are level sensors 104–112, each comprising a pair of probes set at a particular level within the reservoir or cavity of the associated pump. Such level sensors are now well known to those skilled in the art, and comprise a switch which is "made" and "broken" by the syrup within the cavity or reservoir. It will be appreciated that the level sensors 104–112 may be at various positions, and need not be horizontally aligned. In such cases, the uppermost probe of the level sensor would establish the "full" level for the syrup. In the embodiment shown, each of the level sensors 104–112 has a uniquely associated resistor 114–122 connected to an appropriate voltage source. As further shown, the other side of the level sensors 104–112 is connected to ground.

Also included as part and parcel of the instant invention is a pressurized source of $CO_2$ gas 124 which is preferably regulated to attain a relatively constant pressure output. A three-way valve 126, commonly used in such dispensing systems, is interposed between the gas pressure source 124 and the conduit or manifold 128 which feeds to the interior cavity of all of the pumps 24–32. Also connected to the manifold 128 and servicing the cavities of each of the pumps 24–32 is a vacuum pump 130. A valve 132 may, if desired, be interposed within the manifold 128 between the vacuum pump 130 and the pumps 24–32.

Also included as part and parcel of the invention is a control unit 134 such as a dedicated microprocessor or the like. As shown, the microprocessor is interconnected with each of the fill valves 54–62, level sensors 114–122, and dispensing valves 84–92. Additionally, the control unit 134 is interconnected with the three-way valve 126 and the vacuum pump 130 and valve 128 as shown. The function and operation of the control unit 134 in conjunction with the syrup dispensing assembly 10 will become apparent below.

At the beginning of operation, the reservoirs of each of the pumps 24–32 is filled to the levels set by the level sensors 104–112. Typically, each of the supplies 12–20 will contain a separate and distinct flavoring syrup, such that each of the pumps 24–32 will similarly have an associated distinct syrup. When a user selects a soft drink for dispensing, as by actuation of a selector switch, pour switch, or the like, the microprocessor 134 actuates the three-way valve 126 to allow the pressurized $CO_2$ from the source 124 to communicate through the manifold 128 to the interior of each of the pumps 24–32. Accordingly, the pumps have a set pressure head therein. The control unit 134 then actuates the selected dispensing valve 84–92 such that syrup is urged by the pressure head out of the chamber of the pump and out of the associated dispensing head 74–82. At the termination of the dispensing cycle, as determined by time or other appropriate means, the control unit 134 deactivates the dispensing valve 84–92, terminating the syrup flow. Subsequently, the three way valve 126 is closed to disconnect the pressurized source of $CO_2$ gas 124 from the pumps 24–32. If desired, the three-way valve 126 can, at this time, be actuated to vent the pumps 24–32 to atmosphere for a short period of time, depressurizing the pumps.

Assuming that the dispensing discussed above was of flavoring syrup from the pump 24, it will be appreciated that the level of syrup within the chamber of the pump 24 will have fallen below the level of the sensing probes 104. Accordingly, with the sensing probes "open," a high voltage level is apparent at the associated input of the control unit 134, indicating that the reservoir of the pump 124 is not at its "full" level. To replenish the syrup supply within the pump 24, with the valve 126 closed, the vacuum pump 130 and valve 132 are actuated such that a vacuum is introduced through the manifold 128 to the interior chamber of each of the pumps 24–32. The control unit 134 then opens the fill valve 54, allowing communication of syrup from the bag-in-box supply 12 through the conduit 34 and into the chamber of the pump 24 under control of the vacuum generated by the pump 130. Syrup enters the pump 24 until the probes of the level sensor 104 are interconnected by the syrup, indicating a full level. At this time a "ground" signal is passed to the appropriate input of the unit 134, indicating that the pump 24 has been replenished to its full level. The valve 54 is then closed, the vacuum pump 130 is deactivated, and the valve 132 is closed, terminating the replenishing cycle.

It will be appreciated that no syrup or beverage will typically enter the manifold 128 or access the valves 126, 132 or vacuum pump 130. Indeed, these elements will typically operate in an environment of $CO_2$ gas, prolonging the life of the elements, and reducing likelihood of sticking, clogging, and the like. It should further be understood that the control unit 134 functions to assure that the pressure source 124 and the vacuum source 130 are mutually exclusively interconnected to the manifold 128 and, hence, the pumps 24–32. The pressure source communicates with pumps for a dispensing cycle, while the vacuum source communicates with the pumps for a refill cycle.

Employing the apparatus and technique presented herein, a plurality of bag-in-box or bulk syrup supplies may be used in a single syrup dispensing system, with full depletion and use of the supplies being attained by a single vacuum pump servicing all of the supplies. The apparatus and technique may also be employed with pressurized syrup supply sources with the vacuum pump assisting in and assuring the transfer of syrup from the supply source to the pumps and precluding the injection of gas "slugs" and the like into the dispensing line.

It will further be appreciated that, while the example given above was with respect to a single pump 24 and associated dispensing head 74, the same operation would be true with respect to any of the remaining pumps, dispensing heads, and associated elements. It will further be appreciated that, since all the pumps are pressurized and evacuated simultaneously, dispensing of different drinks from different dispensing heads can be concurrent, as can be the replenishing of the pumps 24–32. Further, it will be understood that a single vacuum pump 130 is available for servicing each of the syrup supplies 12–20 and operates in substantially the same manner, whether the supply is from a bag-in-box, bulk gravity feed, or pressurized canister.

As presented above, the metering adjustment valves 94–102 are provided in respective dispensing lines to adjust the rate of syrup dispensing to accommodate the various different syrups of the pumps 24–32, all being dispensed under the same pressure head.

It will also be appreciated by those skilled in the art that the control unit or microprocessor 134 will typically include a timing function associated with the refill cycle. In other words, once one of the level sensing probes 104–112 indicates a need for replenishment of the syrup, the vacuum pump 130 and valve 132 are activated and the appropriate fill valve or valves 54–62 are similarly activated. From this point of activation, a timer is started. If the associated pump 24–32 is not refilled to the set level of the associated sensor 104–112 within a set period of time, the microprocessor 134 determines that the associated supply 12–20 is empty and that the pump is therefore incapable of refilling. After such time period, the appropriate fill valve 54–62 is closed, and the control unit 134 actuates an appropriate indicia such as a lamp or the like to indicate that a particular syrup supply is empty. At such time, the associated dispensing valve 84–92 is similarly disabled by the control unit 134.

Thus is can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A syrup dispensing assembly for a soft drink dispenser, comprising:

a supply of syrup;

a dispensing head;

pump means interposed between said supply of syrup and dispensing head for receiving syrup from said supply and passing it to said dispensing head;

vacuum generating means interconnected with said pump means for drawing syrup from said supply to said pump:

control means interconnected with said vacuum generating means for selectively actuating said vacuum generating means to draw said syrup to said pump means; and pressure generating means interconnected with said pump means for introducing a pressure head to said pump means for passing said syrup to said dispensing head.

2. The syrup dispensing assembly according to claim 1, wherein said control means further interconnects and controls said pressure generating means, said control means mutually exclusively activating said vacuum generating means and said pressure generating means.

3. The syrup dispensing assembly according to claim 1, wherein said pump means comprises a chamber receiving syrup from said supply, and in selective communication through said control means with said vacuum generating means and said pressure generating means.

4. The syrup dispensing assembly according to claim 3, wherein said supply of syrup comprises an unpressurized bulk supply of syrup.

5. The syrup dispensing assembly according to claim 3, wherein said supply of syrup comprises a pressurized source of syrup.

6. The syrup dispensing assembly according to claim 3, wherein said control means includes sensing means interposed between said chamber and said vacuum generating means for sensing a level of said syrup within said chamber and causing activation of said vacuum generating means when said level drops below a set level.

7. The syrup dispensing assembly according to claim 3, wherein said supply of syrup comprises a bag-in-box supply of syrup.

8. A syrup dispensing assembly for a soft drink dispenser, comprising;

a plurality of pumps, each pump defining a chamber;

a plurality of sources of syrup in selective communication with said chambers of said pumps;

a pressure source in selective communication with said chambers of said pumps;

a vacuum source in selective communication with said chambers of said pumps; and control means interconnected with said sources of syrup, pressure source and vacuum source for effecting said selective communications of said syrup, vacuum, and pressure sources with said chambers of said pumps and for selectively and mutually exclusively enabling and inhibiting communication of said pressure and vacuum sources with said chambers of said pumps.

9. The syrup dispensing assembly according in claim 8, wherein said control means comprises a fill valve interposed between each of said sources of syrup and said chambers of an associated one of said pumps, said control means selectively actuating said fill valves allowing communication between associated sources of syrup and pump chambers.

10. The syrup dispensing assembly according to claim 9, wherein said pressure source and vacuum source communicate with said chamber of said pumps through common lines.

11. A syrup dispensing assembly according to claim 9, wherein each of said pumps has a dispensing line with an associated dispensing valve, said dispensing valves being actuated by said control means to dispense syrup from said associated pump concurrent with said control means enabling communication of said pressure source and inhibiting communication of said vacuum source with said pumps.

12. The syrup dispensing assembly according to claim 11, wherein each of said dispensing lines has an adjustable metering valve therein for establishing a rate of flow of syrup therethrough at a pressure head established in an associated pump chamber by said pressure source.

13. The syrup dispensing assembly according to claim 11, further comprising level sensing means associated with each of said chambers of said pumps and interconnected with said control means, said control means opening an associated fill valve when said level sensing means indicates a level of syrup in an associated pump chamber is below a set level.

14. The syrup dispensing assembly according to claim 13, wherein said control means opens said fill valve only when an associated dispensing valve is closed and concurrent with said control means inhibiting communication of said pressure source with said pumps and enabling communication of said vacuum source with said pumps.

15. The syrup dispensing assembly to claim 13, wherein said control means monitors said level sensing means during communication of said vacuum source with said pumps and, upon determining that said level of syrup within said pump chamber has not reached said set level within a fixed time period following opening of said fill valve, generates an indicia that an associated source of syrup is empty.

16. The syrup dispensing assembly according to claim 15, wherein said control means inhibits operation of said associated dispensing valve following said fixed time period.

* * * * *